United States Patent [19]

Kitai et al.

[11] Patent Number: 4,970,976

[45] Date of Patent: Nov. 20, 1990

[54] OVERLOCK SEWING MACHINE

[75] Inventors: Koji Kitai; Masanori Mizunuma; Tatsuo Kikuchi, all of Tochigi, Japan

[73] Assignee: SSMC Inc., Edison, N.J.

[21] Appl. No.: 440,840

[22] Filed: Nov. 24, 1989

[51] Int. Cl.[5] ..... D05B 1/20; D05B 57/06; D05B 1/10

[52] U.S. Cl. ..... 112/162; 112/168

[58] Field of Search ..... 112/168, 162, 166, 200, 112/199

[56] References Cited

U.S. PATENT DOCUMENTS 4,690,080 9/1987 Mikuni ..... 112/168 X 4,799,439 1/1989 Koshinaka et al. ..... 112/168 X

*Primary Examiner*—Peter Nerbun

*Attorney, Agent, or Firm*—Theodore Jay

[57] ABSTRACT

There is disclosed an overlock sewing machine. The overlock sewing machine includes a looper switching unit for selecting an overlocking operative state or overlocking inoperative state, a needle clamp member having a first needle holding hole in which two needles are mounted separately in the manner that the two needles are positioned in parallel and a second needle holding hole positioned slightly eccentrically at the front side of the cloth feeding direction and perpendicular to the cloth feeding direction, whereby eight types of overlocking operations and one type of double-loop stitching operation can be effected.

1 Claim, 8 Drawing Sheets

OVERLOCK SEWING MACHINE

BACKGROUND OF THE INVENTION

1. Field of the Invention:

The present invention relates to an overlock sewing machine for carrying out an overlocking operation. 2. Description of the Prior Art:

A prior art overlock sewing machine includes a chain looper, an upper looper, a lower looper, and two needles positioned aslant in the cloth feeding direction and respectively cooperative with the chain, the upper and the lower loopers, to effect an overlocking operation by two needles with five threads (Stitch #516 (=#401+#504) according to JIS L0120 Classification of Stitching Type and Indication Symbol, hereinafter simply referring to Stitch #). In the prior art overlock sewing machine, it is known that the upper looper is exchanged for an overlock looper to effect an overlocking operation by two needles with four threads (#515 (=#401 +#503)).

It is also known that double-loop stitching operation (Stitch #401) can be effected by use of only the chain looper.

In the overlock sewing machine having the upper looper, the lower looper, and two needles positioned in parallel and crossing the cloth feeding direction, it is a so known by exchanging the upper looper for the spreader to effect an overlocking operation by two needles with three threads (Stitch #509).

That is, stitches formed by the overlock sewing machine having two needles positioned aslant in the cloth feeding direction with five threads and a chain looper are Stitch #516, Stitch #504, Stitch #505 and Stitch #401, and stitches formed by the same sewing machine in which the upper looper is exchanged for the overlock looper are Stitch #515, Stitch #512 and Stitch #503.

Stitches obtained by the overlock sewing machine having two needles crossing the cloth feeding direction, the upper and the lower loopers, and four threads are Stitch #514, Stitch #504 and Stitch #505, and stitches formed by the same sewing machine in which the upper looper is exchanged for the spreader are Stitch #509,Stitch #502 and Stitch #503.

A looper switching unit is recently invented in which a looper switching operation is carried out on an upper looper fixing table or a lower looper fixing table for serving as the spreader as disclosed, for example, in Japanese Patent Publication No. 56-13478. Use of the looper switching unit makes it possible to provide the overlock sewing machine capable of sewing two types of overlocking operations.

However, the prior art overlock sewing machine can not effect both overlocking operations for forming Stitch #514 requiring the arrangement of two needles crossing the cloth feeding direction and for forming the Stitch #516 requiring the arrangement of two needles aslant in the cloth feeding direction. Hence, there occurred such a problem that a plurality of overlock sewing machines are needed for effecting the overlocking operations set forth above.

SUMMARY OF THE INVENTION

The present invention has been made in view of the problem of the prior art overlock sewing machine as set forth above.

Therefore, it is an object of the present invention to provide an overlock sewing machine capable of two types of overlocking operations, and double-loop stitching operation, especially capable of serving to form a Stitch requiring two needles crossing the cloth feeding direction and a stitch requiring two needles aslant in the cloth feeding direction to thereby increase the function of the overlock sewing machine.

To achieve the above object, the overlock sewing machine of the present invention comprises needles vertically movable and fixed to a lower end of a needle bar each of the needles having needle threads threaded into holes thereof provided at the tip end thereof, a chain looper having a needle hole at the tip end thereof through which a chain looper thread is threaded, an upper looper having a needle hole at the tip end thereof through which an upper looper thread is threaded, a lower looper having a needle hole at the tip end thereof through which a lower looper thread is threaded, the needles, the chain looper, the upper and the lower loopers being cooperative with each other for carrying out an overlocking operation, characterized in that the upper looper is provided with a looper switching unit for selecting to an overlocking operative state or overlocking inoperative state, and the overlock sewing machine further comprises a needle clamp member having a first needle holding hole in which two needles are mounted separately in the manner that the two needles are positioned in parallel and a second needle holding hole positioned slightly eccentrically at the front side of the cloth feeding direction and perpendicular to the cloth feeding direction, whereby the following operations can be made by the overlock sewing machine: two types of overlocking operation by one needle with two needle threads, two types of overlocking operation by one needle with three needle threads, one type of overlocking operation by two needles with three needle threads, two types of overlocking operation by two needles with four needle threads, one type of overlocking operation by two needles with five needle threads, or one type of double looping operation by one needle with two needle threads.

The above and other objects, features and advantages of the present invention will become more apparent from the following description taken in conjunction with the accompanying drawings.

DESCRIPTION OF THE PREFERRED EMBODIMENT

Figure 1:
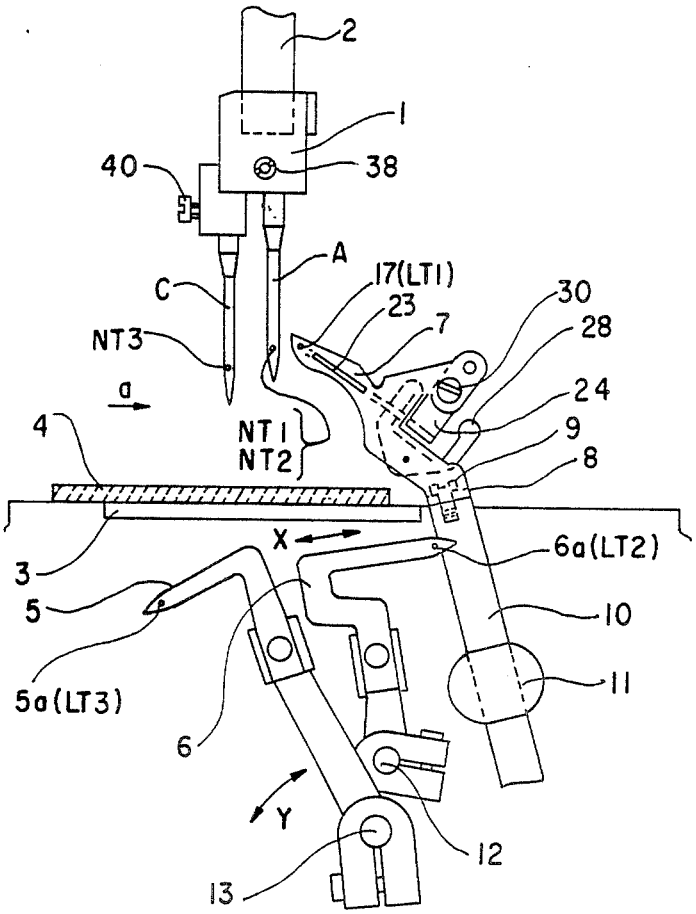
FIG. 1 is a view of assistance in explaining a main portion of an overlock sewing machine according to the present invention.
Figure 2:
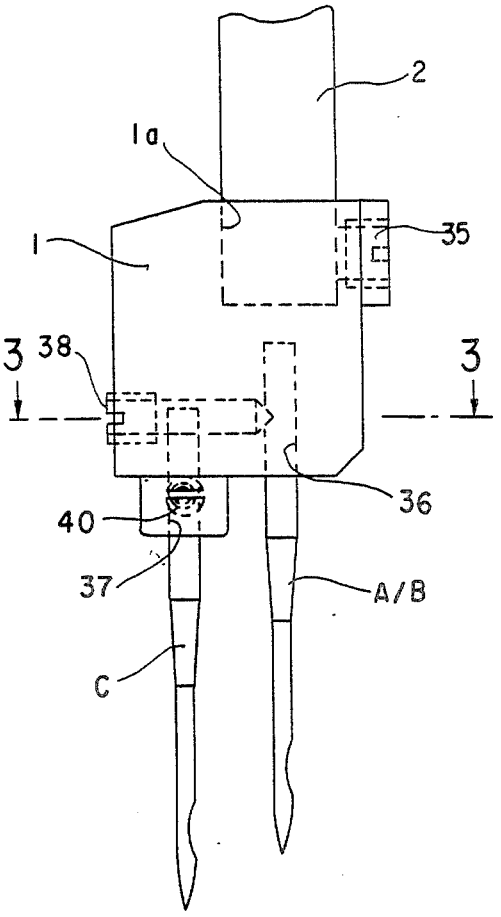
FIG. 2 is a view showing a needle clamp member employed in the overlock sewing machine of FIG. 1.

An overlock sewing machine according to a preferred embodiment of the present invention will be described with reference to FIGS. 1 to 17.

An overlock sewing machine comprises needles A, B, C vertically movable and fixed to a lower end of a needle bar 2, each of the needles A, B, C having needle threads NT1, NT2, NT3 threaded into holes thereof provided at the tip end thereof, a chain looper 5 having a needle hole 5A at the tip end thereof through which a chain looper thread LT3 is threaded, an upper looper 7 having a needle hole 17 at the tip end thereof through which an upper looper thread LT1 is threaded, a lower looper 6 having a needle hole 6a at the tip end thereof through which a lower looper thread LT2 is threaded, the needles A, B, C, the chain looper 5, the upper and the lower loopers 7, 6 being cooperative with each other for carrying out an overlocking operation, characterized in that the upper looper 7 is provided with a looper switching unit for selecting to an overlocking operative state or an overlocking inoperative state, and the overlock sewing machine further comprises a needle clamp member 1 having a first needle holding hole 36 in which two needles A, B are mounted separately in the manner that the two needles A, B are positioned in parallel and a second needle holding hole 37 positioned slightly eccentrically at the front side of the cloth feeding direction and perpendicular to the cloth feeding direction, whereby the following operations can be made by the overlock sewing machine: two types of overlocking operation by one needle with two needle threads, two types of overlocking operation by one needle with three needle threads, one type of overlocking operation by two needles with three needle threads, two types of overlocking operation by two needles with four needle threads, one type of overlocking operation by two needles with five needle threads, or one type of double looping operation by one needle with two needle threads.

The overlock sewing machine will be described more in detail.

A needle clamp member 1 is fixed to the lower portion of the needle bar 2 vertically movable within a frame (not shown) of the sewing machine. The needle clamp member 1 has the first and the second needle holding holes 36, 37 which are fixed thereto and serve to function as three holes. The chain looper 5, the lower looper 6, the upper looper 7 are respectively arranged under the needle bar 2.

The chain looper 5 is positioned under a throat plate 3 and moves forward and backward in the cloth feeding direction (in the direction of arrow a) of the processed cloth 4 on the throat plate 3 or in the direction crossing the cloth feeding direction and cooperating with a needle C (described later) to effect the double-loop stitching operation. More in detail, the chain looper 5 swings about a chain looper shaft 13 crossing the cloth feeding direction and also swings reciprocally in the direction of the arrow Y in FIG. 1 while the chain looper shaft per se moves horizontally reciprocally in the axial direction thereof. The lower looper is positioned under the throat plate 3 at the stitching operation and moves forward and backward in the direction crossing the cloth feeding direction of the processed cloth 4 (in the direction of the arrow a). More in detail, the lower looper 6 having the needle hole 6a through which the lower looper thread LT2 is threaded and swings about a lower looper shaft 12 extending in the direction crossing the cloth feeding direction (in the direction of the arrow a) and swings reciprocally in the direction of the arrow X as shown in FIG. 1. The upper looper 7 cooperates with the lower looper 6 at the time of stitching operation to effect the overlocking operation.

The structure of the upper looper 7 and the needle clamp member 1 of the overlock sewing machine according to the present invention is different from those of the prior art overlock sewing machine although driving mechanisms for driving the upper looper 7 and the needle clamp member 1 are the same as those of the prior art overlock sewing machine. The other portion, namely, the chain looper 5 and the lower looper 6 are substantially the same as those of the prior art overlock sewing machine in respect of the structures and the driving mechanisms thereof. Hence, the upper looper 7 and the needle clamp member 1 will be described more in detail hereinafter.

Figure 3:
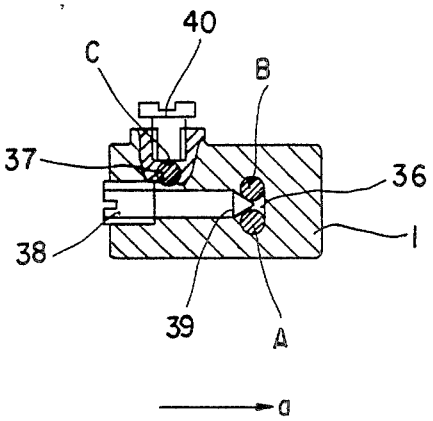
FIG. 3 is a cross sectional view taken along III—III of FIG. 2.

The needle clamp member 1 has a recess le in which the lower end of the needle bar 2 is inserted and screwed by a set screw 25 so that the needle bar 2 is detachably fixed to the needle clamp member 1. The needle clamp member 1 is capable of detachably attaching three needles A, B, C thereto, which needles are receptively extending in parallel with the axial line of the needle bar 2. For this purpose, the needle clamp member 1 has the first and second needle holding holes 36, 37 respectively extending in parallel with the axial line of the needle bar 2 which are respectively defined at the portion opposite to the recess 1a. The first needle holding hole 36 of longitudinal circular shape and having both ends concaved circular arc shape is positioned just under the needle bar 2 and extends perpendicular to the cloth feeding direction of the processed cloth 4 while the second needle holding hole 37 having a circular shape in cross section is positioned slightly eccentrically in front of the cloth feeding direction of the processed cloth (in the direction of the arrow a). The two needles A, B are inserted adjacently and parallel with each other into the first needle holding hole 36 and are detachably attached to the needle holding hole 36 by a long needle clamp thumb screw 38 which is screwed into the needle clamp member 1. That is, a conical tip end 39 of the first needle clamp thumb screw 38 is inserted between the first and the second needles A, B and brought into contact with the first and the second needles A, B. The single needle C is inserted into the second needle holding hole 37 as shown in FIG. 3 and detachably attached to the second needle holding hole 37 by a short needle clamp thumb screw 40. A flat tip end of the first needle clamp thumb 40 is brought into contact with the single needle C.

The upper looper 7 has a seat portion 8 in which a et screw 9 is screwed to fix the upper looper 7 to an upper end of an upper looper attaching lever 10. The upper looper attaching lever 10 penetrates slidably through an upper looper guide 11 rotatably mounted at the front of he frame of the sewing machine for delivering a predetermined repetitive motion crossing the cloth feeding direction of the process cloth 4 to the upper looper 7.

Figure 4:
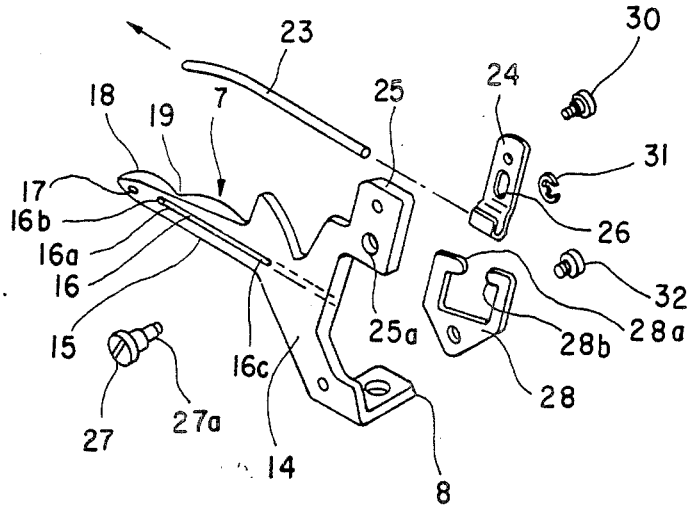
FIG. 4 is a perspective exploded view showing an upper looper employed in FIG. 1.
Figure 5:
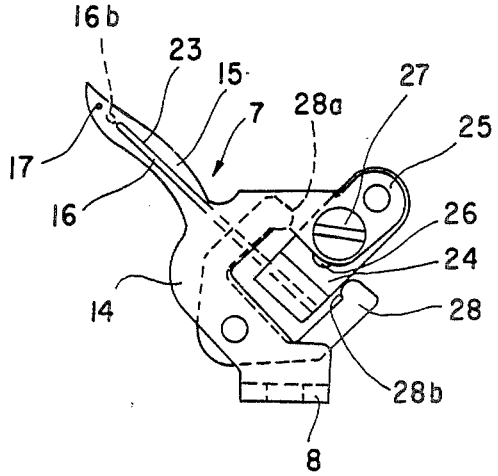
FIG. 5 is view of assistance in explaining an upper looper not forming a spreader.
Figure 6:
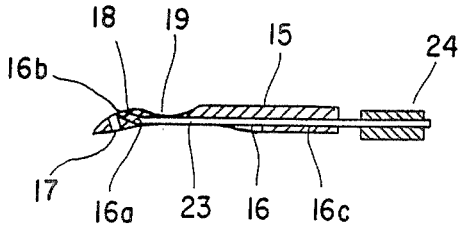
FIG. 6 is a cross sectional view of a main portion of FIG. 5.

The upper looper 7 is illustrated in detail in FIG 4 and comprises a side wall portion 14 extending from the front end of the seat portion 8 and bent to some angle, a blade portion 15 extending from the side wall portion 14 and directing toward the needle A or B (leftward in the figure), and a bracket portion 25 extending upward from the side wall portion 14. The front side of the blade portion 15 has a guide passage 16 extending from the right base end of the side wall portion 14 toward the tip end of the blade portion 15. The guide passage 16 is provided, as shown in FIGS. 5 and 6, for guiding a flexible rod shape horn 23 which can be slidably inserted into the guide passage 16. The tip end of the guide passage 16 has a tip end side passage 16*b* which extends from the guide passage 16 and reaches and opens at the base end side rear surface adjacent to a thread hole 17 of the blade portion 15 (upper portion in FIG. 6).

Figure 8:
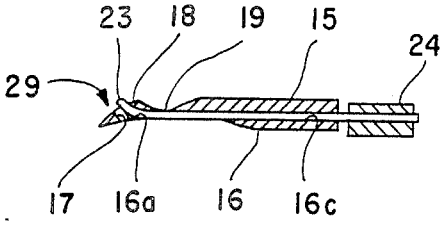
FIG. 8 is a cross sectional view of a main portion of FIG. 7.

A line extending from the tip end side passage 16*b* crosses the needle thread hole 17 defined by penetrating the front and rear side of the tip portion of the blade portion 15 in the space at the rear side of the blade portion 15. A base end of the curved portion 16*a* extends to a base side passage 16*c* extending longitudinally to the blade portion 15. The base side passage 16*c* has a free front side at the tip end thereof for reducing its weight. A tip end rear surface of the blade portion 15 has a projected portion 18 and a recessed portion 19 continuing from the tip end of the blade portion 15. The horn 23 inserted into the guide passage 16 can be inserted into or retracted from the opening of the tip end side passage 16*b*. With the state where the tip portion of the horn 23 being projected from the opening of the tip end side passage 16*b* in a predetermined length, there is defined a spreader 29 by the projected tip end of the horn 23 and the tip end side rear surface of the blade 15 of the upper looper 7 as shown in FIG. 8. The horn 23 may be made of a steel having a diameter of about 1 mm but preferable to be made of a plastic fiber since the plastic fiber is superior in respect of friction coefficient, conformability, wearing resistance with respect to the stitching thread and also superior in respect of elasticity and easiness of processing.

The base end, projected from the base side passage 16*c*, of the horn 23 is held by a holding member 24 as shown in FIGS. 4, 5 and 6. That is, the base end of the horn 23 is held by the holding member 24 which is substantially swingable in the longitudinal direction of the base end passage 16*c*. The holding member 24 is swingably supported by a hinge screw 30 which is screwed into a screw hole of the bracket portion 25 of the upper looper 7. There is defined in the holding member 24 a slit 26 substantially crossing the base end side passage 16*c*. An eccentric pin 27 serving as an operation member has a large diameter portion inserted into a through hole 25*a* of the bracket portion 25 and a small diameter portion 27*a* engaged in the slit 26 to prevent it from being extracted from the slit 26 by a set ring 31 made of C-shaped clip. Accordingly, the eccentric pin is turned clockwise or conterclockwise and the small diameter portion 27*a* is eccentrically turned within the slit 26 so that the holding member 24 is swung about the hinge screw 30 thereby the horn 23 can be moved longitudinally forward and backward. A U-shaped positioning means 28 is fixed to the side wall portion 14 by fitting a central small hole of the U-shaped positioning means 28 into a screw hole provided at the lower end of the side wall portion 14 and both holes are screwed by a screw 32 while the positioning means 28 is positioned relative to the side wall portion 14. The holding member 24 is received by an upward directed opening of the side wall portion 14. Hence, an operative position of the horn 23 obtained by forward movement of the lower portion of the holding member 24 is determined by contact of the holding member 24 with a tip end side inner edge 28*a* and an inoperative position of the horn 23 obtained by backward movement of the holding member 24 is determined by contact of holding member 24 with a base end side inner edge 28*b*. The operative position or the inoperative position is selected by loosening the screw 32 to adjust the inclination angle of the positioning means 28 relative to the side wall portion 14.

With the arrangement of the overlock sewing machine, the looper switching unit is operated to allow the upper looper 7 to form the spreader 29 or not to form the spreader 29. Combinations obtained by various attachments of the three needles A, B, C to the needle clamp member 1 make it possible to perform various overlocking operations.

Various overlocking operations to be obtained by the present invention will be described hereinafter.

Figure 9:
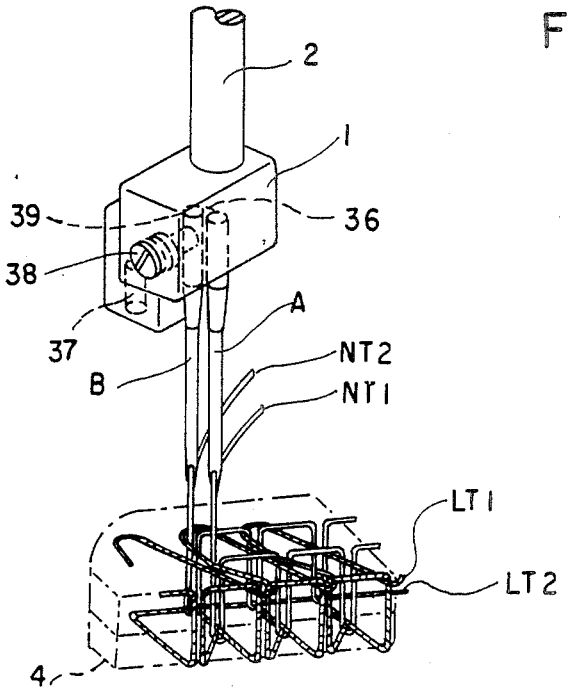
FIG. 9 is a view of assistance in explaining an overlocking operation of Stitch #514.

I. Stitch #514 made by two needles with four threads:

In FIG. 9, two needles A, B are inserted in parallel with each other into the first needle holding hole 36 to effect the overlocking operation by two needles with four threads The conical tip end 39 of the needle clamp thumb screw 38 presses and brings into contact between the needles A, B to thereby press the needles A, B individually toward an inner wall of the first needle holding hole 36. The stitch made by Stitch #514 is formed by the intertwining needle thread NT1, NT2 threaded into the needles A, B, the upper looper thread LT1 threaded into the thread hole 17 of the upper looper 7, and the lower looper thread LT2 threaded into the thread hole 6*a* of the lower looper 6.

Figure 10:
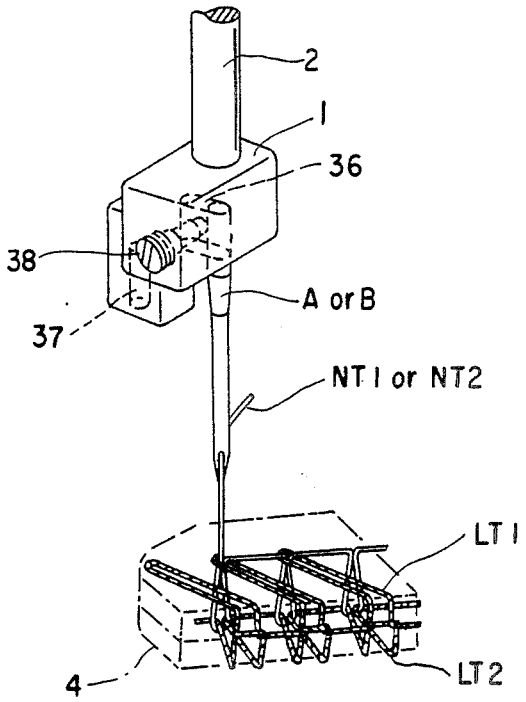
FIG. 10 is a view of assistance in explaining an overlocking operation of Stitch #504.
Figure 11:
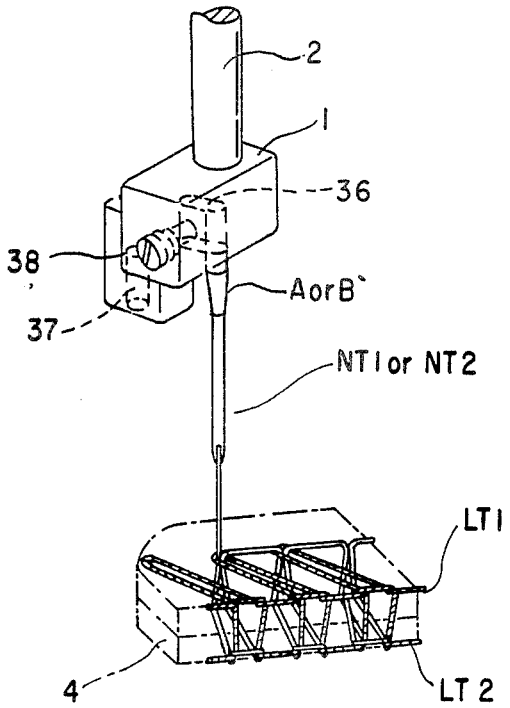
FIG. 11 is a view of assistance in explaining an overlocking operation of Stitch #505.
Figure 12:
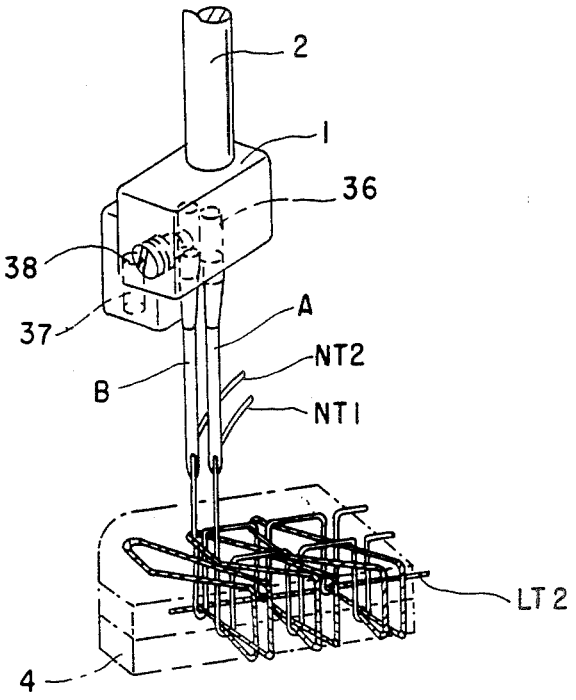
FIG. 12 is a view of assistance in explaining an overlocking operation of Stitch #509.

II. Stitch #504 and #505 made by one needle with three threads:

In FIGS. 10, 11, one of the needles A, B inserted into the first needle holding hole 36 is cooperative with the upper looper 7 and the lower looper 6 to effect the overlocking operation. That is, the needle thread NT1 or NT2 threaded into the needle thread of the needle A or the needle B, the upper looper thread LT1 threaded into the thread hole 17 of the upper looper 7, and the lower looper thread LT2 threaded into the thread hole 6*a* of the lower looper 6 are intertwined with each other for effecting Stitch #504 (FIG. 10) or Stitch #505 (FIG. 11) respectively made by one needle with three threads.

Figure 7:
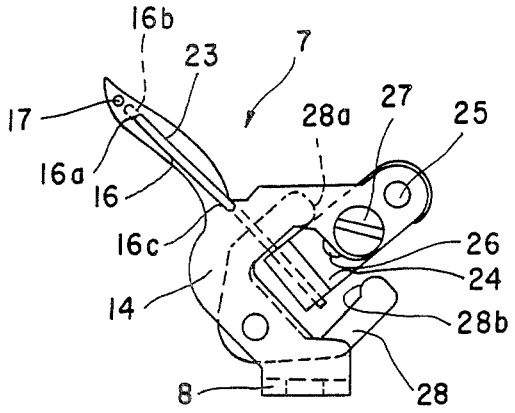
FIG. 7 is view of assistance in explaining an upper looper forming a spreader.

III Stitch #509 made by two needles with three threads:

In FIGS. 7, 8, the eccentric pin 27 is turned to permit the holding member 24 to bring into contact with the tip end side inner edge 28*a* of the positioning member 28 so that the tip end portion of the horn 23 is projected from the opening of the tip end side passage 16*b* of the upper looper 7 in a predetermined length to thereby position the horn 23 in an operative position whereby the spreader 29 formed with the tip end rear surface of the upper looper 7 is selected. At the same time, the needles A, B are inserted into the first needle holding hole 36 in parallel with each other to effect the overlocking operation by two needles with three threads.

The stitch made by Stitch #509 is formed by intertwining the needle thread NT1, NT2 respectively threaded into the thread holes of the needles A, B, and the lower looper thread LT2 threaded into the thread hole 6a of the lower looper 6.

Figure 13:
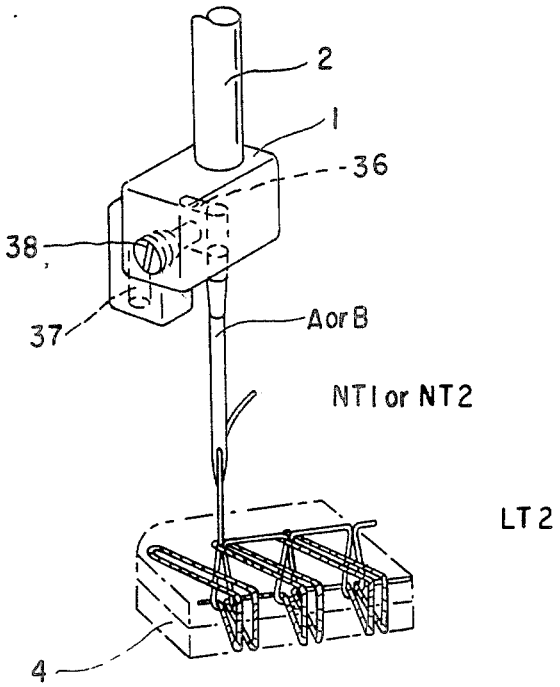
FIG. 13 is a view of assistance in explaining an overlocking operation of Stitch #502.
Figure 14:
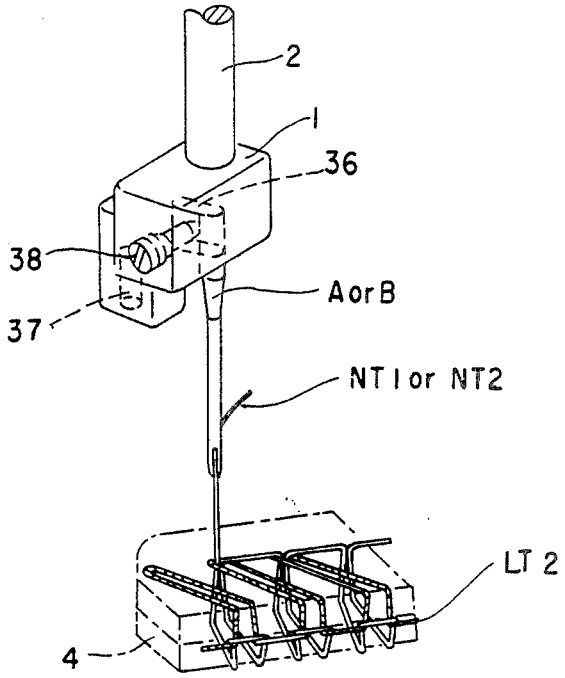
FIG. 14 is a view of assistance in explaining an overlocking operation of Stitch #503.

IV. Stitch #502, #503 made by one needle with two threads:

In FIGS. 13, 14, one of the needles A and B inserted into the first needle holding hole 36 is cooperative with the lower looper 6 and the spreader 29 to effect the overlocking operation by one needle with two threads. That is, the needle thread NT1 threaded into the needle thread hole of the needle A or the needle thread NT2 threaded into the thread hole of the needle B, and the lower looper thread LT2 threaded into the thread hole 6a of the lower looper 6 are intertwined with each other to effect the overlocking operation of Stitch #502 (FIG. 13) or Stitch #503 (FIG. 14) respectively made by one needle with two threads.

Figure 15:
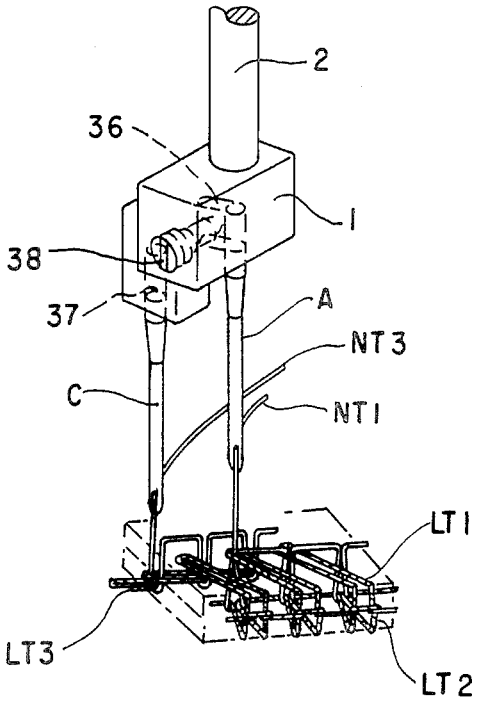
FIG. 15 is a view of assistance in explaining an overlocking operation of Stitch #516.
Figure 16:
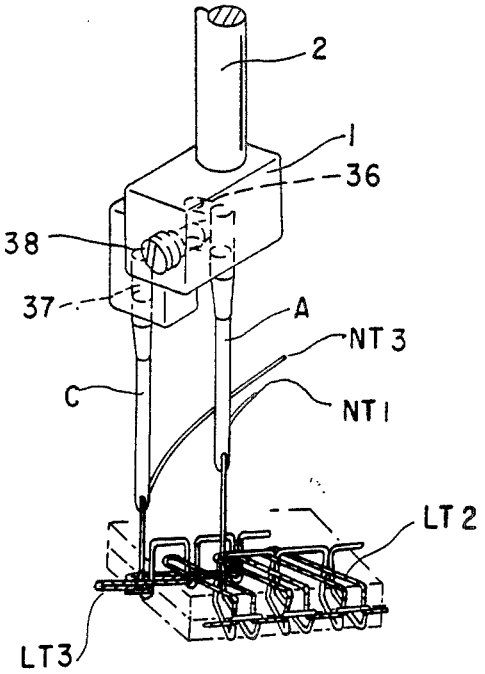
FIG. 16 is a view of assistance in explaining an overlocking operation of Stitch #515.

V. Stitch #516 (Stitch #401+Stitch #504) made by two needles with four threads:

In FIG. 15, the first needle clamp thumb screw 38 is operated to attach the first needle holding hole 36 and the second needle clamp thumb screw 40 is operated to attach the second holding hole 37 to effect the overlocking operation by two needles with five threads. The stitch made by Stitch #516 is formed by intertwining the needle threads NT1, NT3 respectively threaded into the needles A, C, the upper looper thread LT1 threaded into the thread hole 17 of the upper looper 7, the lower looper thread LT2 threaded into the thread hole 6a of the lower looper 6, the chain looper thread LT3 threaded into the thread hole 5a of the chain looper 5.

VI. Stitch #515 (Stitch #401+Stitch #503):

In FIGS. 7, 8, the eccentric pin 27 is turned to permit the holding member 24 to contact the tip end side inner edge 28a of the positioning means 28 so that the tip end of the horn 23 is projected from the opening of the tip end side passage 16b of the upper looper 7 in a predetermined length to position the horn 23 in the operative position whereby the spreader 29 formed with the tip end side rear surface of the blade portion 15 of the upper looper 7 is selected and the needle A in the first needle holding hole 36, the needle C attached to the second needle holding hole 37, the chain looper 5, the lower looper 6 and the spreader 29 are cooperative to effect the overlocking operation by two needles with four threads. That is, the stitch made by Stitch #515 is formed by intertwining the needle threads NTI, NT3 respectively threaded into the two needles A, C, the chain looper thread LT3 threaded into the thread hole 5a of the chain looper 5 and the lower looper thread LT2 threaded into the thread hole 6a of the lower looper 6.

Figure 17:
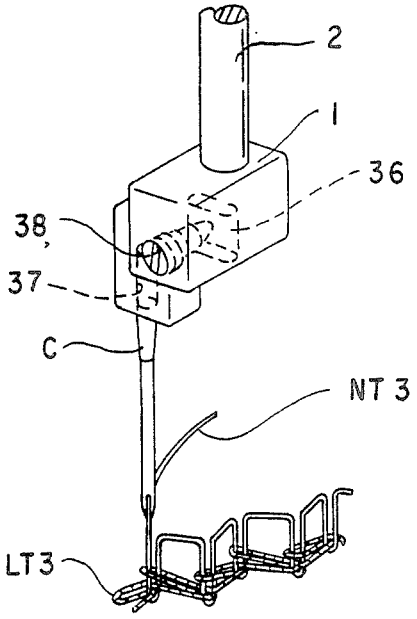
FIG. 17 is a view of assistance in explaining a double-loop stitching operation of Stitch #401.

VII Double-loop Stitch #401 made by one needle with two threads:

In FIG. 17, the needle C in the second needle holding hole 37 and the chain looper 5 are cooperative to effect the double-loop stitching operation. That is, the stitch made by Double-loop Stitch #401 is formed by intertwining the needle thread NT3 threaded into the needle C and the chain looper thread LT3 threaded into the thread hole 5a of the chain looper 5.

With the arrangement of the overlock sewing machine according to the present invention, it is possible to effect eight kinds of overlocking stitching operations and one type of double-loop stitching operation by a single overlocking sewing machine. Particularly, the overlock sewing machine according to the present invention serves to effect Stitch #514 overlocking operation requiring the arrangement of the two needles crossing the cloth feeding direction and Stitch #516 overlocking operation requiring the arrangement of two needles aslant the cloth feeding direction so that the function of the overlock sewing machine can be remarkably improved or increased.

Although the invention has been described in its preferred form with a certain degree of particularity, it is to be understood that many variations and changes are possible in the invention without departing from the scope thereof.

What is claimed is:

1. An overlock sewing machine comprising:

needles vertically movable and fixed to a lower end of a needle bar, each of the needles having needle threads threaded into holes thereof provided at the tip end thereof;

a chain looper having a needle hole at the tip end thereof through which a chain looper thread is threaded;

an upper looper having a needle hole at the tip end thereof through which an upper looper thread is threaded;

a lower looper having a needle hole at the tip end thereof through which a lower looper thread is threaded;

the needles, the chain looper, the upper and the lower loopers being cooperative with each other for carrying out an overlocking operation;

characterized in that the upper looper is provided with a looper switching unit for selecting an overlocking operative state or overlocking inoperative state, and the overlock sewing machine further comprises a needle clamp member having a firSt needle holding hole in which two needles are mounted separately in the manner that the two needles are positioned in parallel and a second needle holding hole positioned slightly eccentrically at the front side of the cloth feeding direction and perpendicular to the cloth feeding direction, whereby the following operations can be made by the overlock sewing machine:

two types of overlocking operation by one needle with two needle threads;

two types of overlocking operation by one needle with three needle threads;

one type of overlocking operation by two needles with three needle threads;

two types of overlocking operation by two needles with four needle threads;

one type of overlocking operation by two needles with rive needle threads; or one type of double-loop stitching operation by one needle with two needle threads.

* * * * *